US006571891B1

(12) United States Patent
Smith et al.

(10) Patent No.: US 6,571,891 B1
(45) Date of Patent: Jun. 3, 2003

(54) WEB CUTTER

(75) Inventors: Redd H. Smith, The Woodlands, TX (US); Danny E. Scott, Montgomery, TX (US); Craig H. Cooley, Ogden, UT (US); Marcus R. Skeem, Sandy, UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/604,717

(22) Filed: Jun. 27, 2000

Related U.S. Application Data

(63) Continuation-in-part of application No. 09/218,952, filed on Dec. 22, 1998, now Pat. No. 6,135,219, which is a continuation-in-part of application No. 09/074,260, filed on May 7, 1998, now Pat. No. 6,098,730, which is a continuation-in-part of application No. 08/633,983, filed on Apr. 17, 1996, now Pat. No. 5,758,733.

(51) Int. Cl.[7] ..... E21B 10/46

(52) U.S. Cl. ..... 175/428; 175/430; 175/432; 175/434

(58) Field of Search ..... 175/426, 428, 175/430–432, 434

(56) References Cited

U.S. PATENT DOCUMENTS

| | | | |
|---|---|---|---|
| 4,109,737 | A | 8/1978 | Bovenkerk |
| RE32,036 | E | 11/1985 | Dennis |
| 4,558,753 | A | 12/1985 | Barr |
| 4,593,777 | A | 6/1986 | Barr |
| 4,660,659 | A | 4/1987 | Short, Jr. et al. |
| 4,679,639 | A | 7/1987 | Barr et al. |
| 4,858,707 | A | 8/1989 | Jones et al. |
| 4,987,800 | A | 1/1991 | Gasan et al. |
| 4,997,049 | A | 3/1991 | Tank et al. |
| 5,016,718 | A | 5/1991 | Tandberg |
| 5,120,327 | A | 6/1992 | Dennis |
| 5,351,772 | A | 10/1994 | Smith |
| 5,355,969 | A | 10/1994 | Hardy et al. |
| 5,379,854 | A | 1/1995 | Dennis |
| 5,435,403 | A | 7/1995 | Tibbitts |
| 5,437,343 | A | 8/1995 | Cooley et al. |
| 5,460,233 | A | 10/1995 | Meany et al. |
| 5,472,376 | A | 12/1995 | Olmstead et al. |
| 5,484,330 | A | 1/1996 | Flood et al. |
| 5,486,137 | A | 1/1996 | Flood et al. |
| 5,494,477 | A | 2/1996 | Flood et al. |
| 5,499,688 | A | 3/1996 | Dennis |
| 5,544,713 | A | 8/1996 | Dennis |
| 5,590,728 | A | 1/1997 | Matthias et al. |
| 5,590,729 | A | 1/1997 | Cooley et al. |
| 5,605,199 | A | 2/1997 | Newton |
| 5,617,928 | A | 4/1997 | Matthias et al. |
| 5,647,449 | A | 7/1997 | Dennis |
| 5,649,604 | A | 7/1997 | Fuller et al. |
| 5,706,906 | A | 1/1998 | Jurewicz et al. |
| 5,709,279 | A | 1/1998 | Dennis |

(List continued on next page.)

FOREIGN PATENT DOCUMENTS

| | | | |
|---|---|---|---|
| GB | 2 300 208 | A | 10/1996 |
| GB | 2 316 698 | A | 4/1998 |

*Primary Examiner*—David Bagnell
*Assistant Examiner*—Zakiya Walker
(74) *Attorney, Agent, or Firm*—TraskBritt

(57) ABSTRACT

A cutter for a drill bit has a superabrasive member joined to a substrate at a three-dimensional interface. The three-dimensional interface comprises a protrusive pattern of interconnected elements comprising projections of the superabrasive member into the substrate and vice versa. The protrusive pattern comprises at least one generally annular member intersected by a series of generally radially extending members for distributing stresses along the interface, enhancing compressive strength, and enabling optimization of the magnitudes and locations of beneficial residual stresses in the superabrasive member and in the vicinity of the substrate.

65 Claims, 8 Drawing Sheets

U.S. PATENT DOCUMENTS

| | | | | | |
|---|---|---|---|---|---|
| 5,711,702 | A | | 1/1998 | Devlin | |
| 5,758,733 | A | | 6/1998 | Scott et al. | |
| 5,823,277 | A | | 10/1998 | Delwiche et al. | |
| 5,862,873 | A | | 1/1999 | Matthias et al. | |
| 5,871,060 | A | | 2/1999 | Jensen et al. | |
| 5,887,580 | A | | 3/1999 | Eyre | |
| 5,890,552 | A | | 4/1999 | Scott et al. | |
| 5,906,246 | A | | 5/1999 | Mensa-Wilmot et al. | |
| 5,928,071 | A | | 7/1999 | Devlin | |
| 5,971,087 | A | | 10/1999 | Chaves | |
| 6,003,623 | A | | 12/1999 | Miess | |
| 6,026,919 | A | | 2/2000 | Thigpen et al. | |
| 6,041,875 | A | | 3/2000 | Rai et al. | |
| 6,065,554 | A | * | 5/2000 | Taylor et al. | 175/430 |
| 6,068,071 | A | | 5/2000 | Jurewicz | |
| 6,082,474 | A | | 7/2000 | Matthias | |
| 6,135,219 | A | | 10/2000 | Scott | |
| 6,189,634 | B1 | | 2/2001 | Bertagnolli et al. | |
| 6,196,340 | B1 | * | 3/2001 | Jensen et al. | 175/431 |
| 6,199,645 | B1 | | 3/2001 | Anderson et al. | |
| 6,202,771 | B1 | | 3/2001 | Scott et al. | |
| 6,227,319 | B1 | * | 5/2001 | Radford | 175/432 |
| 6,315,067 | B1 | | 11/2001 | Fielder | |

* cited by examiner

WEB CUTTER

CROSS-REFERENCE TO RELATED APPLICATIONS

This application is a continuation-in-part of U.S. patent application Ser. No. 09/218,952, filed Dec. 22, 1998 and now issued as U.S. Pat. No. 6,135,219, which is a CIP of Ser. No. 09/074,260 filed May 7, 1998 U.S. Pat. No. 6,098,730 which is a CIP of Ser. No. 08/633,983 filed Apr. 17, 1996 filed as U.S. Pat. No. 5,758,733.

BACKGROUND OF THE INVENTION

1. Field of the Invention

This invention relates generally to superabrasive inserts, or compacts, for abrasive cutting of rock and other hard materials. More particularly, the invention pertains to improved interfacial geometries for polycrystalline diamond compacts (PDC's) used in drill bits, reamers, and other downhole tools used to form bore holes in subterranean formations.

2. Background of Related Art

Drill bits for oil field drilling, mining and other uses typically comprise a metal body into which cutters are incorporated. Such cutters, also known in the art as inserts, compacts, buttons and cutting tools, are typically manufactured by forming a superabrasive layer on the end of a sintered carbide substrate. As an example, polycrystalline diamond, or other suitable abrasive material, may be sintered onto the surface of a cemented carbide substrate under high pressure and temperature to form a PDC. During this process, a sintering aid such as cobalt may be premixed with the powdered diamond or swept from the substrate into the diamond. The sintering aid also acts as a continuous bonding phase between the diamond and substrate.

Because of different coefficients of thermal expansion and bulk modulus, large residual stresses of varying magnitudes and at different locations may remain in the cutter following cooling and release of pressure. These complex stresses are concentrated near the diamond/substrate interface. Depending upon the cutter construction, the direction of any applied forces, and the particular location within the cutter under scrutiny, the stresses may be either compressive, tensile, or shear. In the diamond/substrate interface configuration, any non-hydrostatic compressive or tensile load exerted on the cutter produces shear stresses. Residual stresses at the interface between the diamond table and substrate may result in failure of the cutter upon cooling or in subsequent use under high thermal or fractional forces, especially with respect to large-diameter cutters.

During drilling operations, cutters are subjected to very high forces in various directions, and the diamond layer may fracture, delaminate and/or spall much sooner than would be initiated by normal abrasive wear of the diamond layer. This type of premature failure of the diamond layer and failure at the diamond/substrate interface can be augmented by the presence of high residual stresses in the cutter.

Typically, the material used as a substrate, e.g., carbide such as tungsten carbide, has a higher coefficient of thermal expansion than diamond matrix. This mismatch of coefficients of thermal expansion causes high residual stresses in the PDC cutter during the high-pressure, high-temperature manufacturing process. These manufacturing induced stresses are complex and of a non-uniform nature and thus often place the diamond table of the cutter into tension at locations along the diamond table/substrate interface.

Many attempts have been made to provide PDC cutters which are resistant to premature failure. The use of an interfacial transition layer with material properties intermediate of those of the diamond table and substrate is known within the art. The formation of cutters with non-continuous grooves or recesses in the substrate filled with diamond is also practiced, as are cutter formations having concentric circular grooves or a spiral groove.

The patent literature reveals a variety of cutter designs in which the diamond/substrate interface is three dimensional, i.e., the diamond layer and/or substrate have portions which protrude into the other member to "anchor" it therein. The shape of these protrusions may be planar or arcuate, or combinations thereof.

U.S. Pat. No. 5,351,772 of Smith shows various patterns of radially directed interfacial formations on the substrate surface; the formations project into the diamond surface.

As shown in U.S. Pat. No. 5,486,137 of Flood et al., the interfacial diamond surface has a pattern of unconnected radial members which project into the substrate; the thickness of the diamond layer decreases toward the central axis of the cutter.

U.S. Pat. No. 5,590,728 of Matthias et al. describes a variety of interface patterns in which a plurality of unconnected straight and arcuate ribs or small circular areas characterizes the diamond/substrate interface.

U.S. Pat. No. 5,605,199 of Newton teaches the use of ridges at the interface which are parallel or radial, with an enlarged circle of diamond material at the periphery of the interface.

In U.S. Pat. No. 5,709,279 of Dennis, the diamond/substrate interface is shown to be a repeating sinusoidal surface about the axial center of the cutter.

U.S. Pat. 5,871,060 of Jensen et al., assigned to the assignee hereof, shows cutter interfaces having various ovaloid or round projections. The interface surface is indicated to be regular or irregular and may include surface grooves formed during or following sintering. A cutter substrate is depicted having a rounded interface surface with a combination of radial and concentric circular grooves formed in the interface surface of the substrate.

Drilling operations subject the cutters on a drill bit to extremely high stresses, often causing crack initiation and subsequent failure of the diamond table. Much effort has been devoted by the industry to making cutters resistant to rapid deterioration and failure.

Each of the above-indicated references, hereby incorporated herein, describes a three-dimensional diamond/substrate interfacial pattern which may accommodate certain of the residual stresses in the cutter. Nevertheless, the tendency to fracture, defoliate and delaminate remains. An improved cutter having enhanced resistance to such degradation is needed in the industry.

SUMMARY OF THE INVENTION

The present invention provides a drill bit cutter having a diamond/substrate interface which has enhanced resistance to fracture, defoliation, and delamination. The invention also provides a cutter with a pattern which helps to break up and isolate the areas of high residual stress throughout the interfacial area and having the diamond table with a reduced stress level. The invention still further provides a cutter with enhanced bonding of the diamond table to the substrate.

The invention comprises a cutter having a superabrasive layer overlying and attached to a substrate. The interface between the superabrasive layer and the substrate is configured to enable optimization of the radial compressive prestressing of the diamond layer or table. The interface configuration preferably incorporates a three-dimensional interface having radial members or ribs and at least one generally annular member such as a circular or polygonal member, or an irregularly shaped annular member comprising a combination of curved and straight geometrical segments, arranged in a preselected pattern. Preferably, the radial and nonradial members are interconnected at junctions therebetween such that the diamond table is in nearly uniform radial and circumferential compression. Thus, the desired lowering of the high residual stress of the diamond table within the interior and exterior thereof results in a biaxial compressive prestress and in the vicinity of the interface occurs upon cooling from a high-temperature, high-pressure manufacturing procedure used in forming the cutter.

A decrease in residual radial and circumferential compressive prestress of the diamond table along at least the interface of the table and the substrate counteracts the forces superimposed upon the table during drilling or when conducting other downhole operations, depending on the tool in which the cutter is mounted. The resistance to delamination is also increased.

BRIEF DESCRIPTION OF THE SEVERAL VIEWS OF THE DRAWING

The following drawings illustrate various embodiments of the invention, not necessarily drawn to scale, wherein.

DETAILED DESCRIPTION OF THE INVENTION

The several illustrated embodiments of the invention depict various features which may be incorporated into a drill bit cutter in a variety of combinations.

The invention is a superabrasive drill bit cutter 20 such as a polycrystalline diamond compact (PDC) which has a particular three-dimensional interface 50 between superabrasive, or diamond, table 30 and substrate 40. The interface 50 between the superabrasive layer or table 30 and the substrate 40 is configured to enable optimization of the radial and circumferential compressive stresses of the diamond layer or table 30 by the substrate 40.

It should be understood that when the diamond table 30 and substrate 40 are joined, or stated differently, cojoined at a periphery, to form interface 50, therebetween is substantially completely filled, i.e. there are preferably essentially no spaces remaining unfilled between the superabrasive diamond, or compact, table and the substrate material.

Figure 1A:
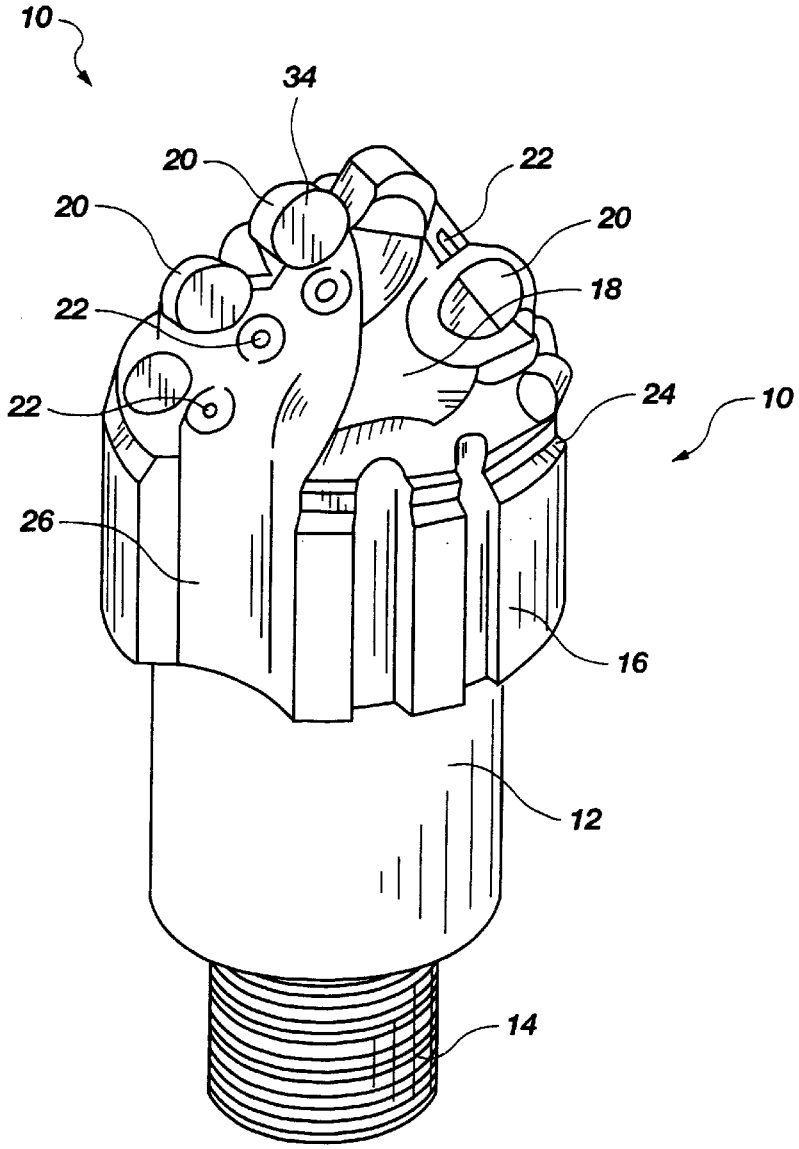
FIG. 1A is a perspective view of an exemplary drill bit incorporating one or more drill bit cutters of the invention.
Figure 1B:
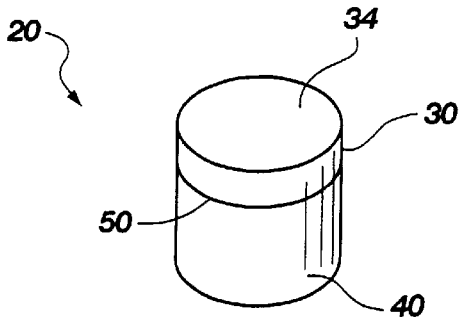
FIG. 1B is an isometric view of an exemplary drill bit cutter of the invention.

In FIGS. 1A and 1B is shown an exemplary, but not limiting, rotary drill bit 10 which incorporates at least one cutting element or drill bit cutter 20 of the invention. The illustrated drill bit 10 is known in the art as a fixed cutter or drag bit useful for drilling in earth formations, and is particularly suitable for drilling oil, gas, and geothermal wells. Cutting elements 20 of this invention may be advantageously used in any of a wide variety of drill bit 10 configurations which use cutting elements. Drill bit 10 includes a bit shank 12 having a tapered pin end 14 for threaded connection to a drill string, not shown, and also includes a body 16 having a face 18 on which cutting elements 20 may be secured. Bit 10 typically includes a series of nozzles 22 for directing drilling mud to the face 18 of body 16 for removal of formation cuttings to the bit gage 24 and to facilitate passage of cuttings through junk slots 26, past the bit shank 12 and up the annulus between the drill string and the well bore toward the surface or to the surface to be discharged. It should be understood that cutting elements of the present invention, including cutting elements 20, can be installed in roller-cone style drill bits wherein cutting elements are preferably installed on a rotatable roller-cone so as to movingly engage and cut the formation.

Figure 2:
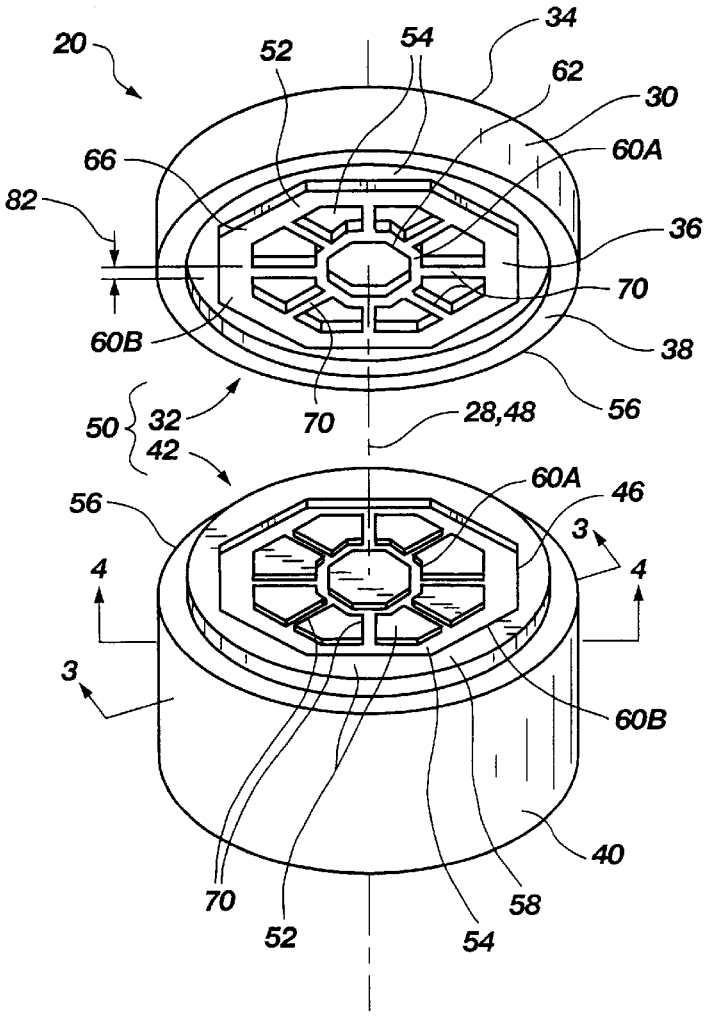
FIG. 2 is an isometric exploded view of an exemplary drill bit cutter of the invention.
Figure 3:
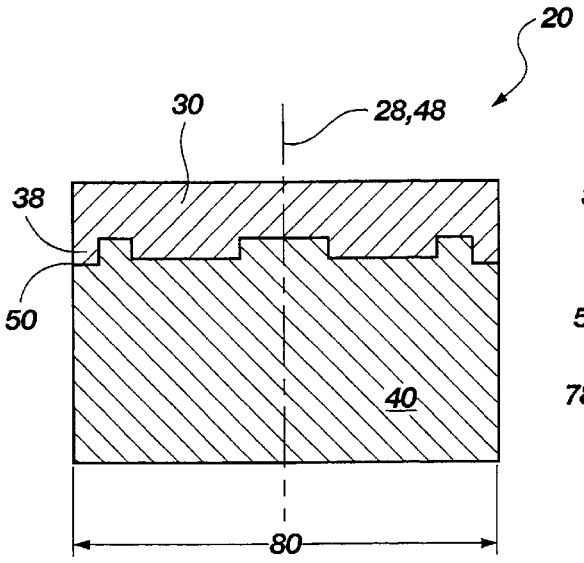
FIG. 3 is a cross-sectional side view of a drill bit cutter of the invention, as taken along line 3—3 of FIG. 2.
Figure 4:
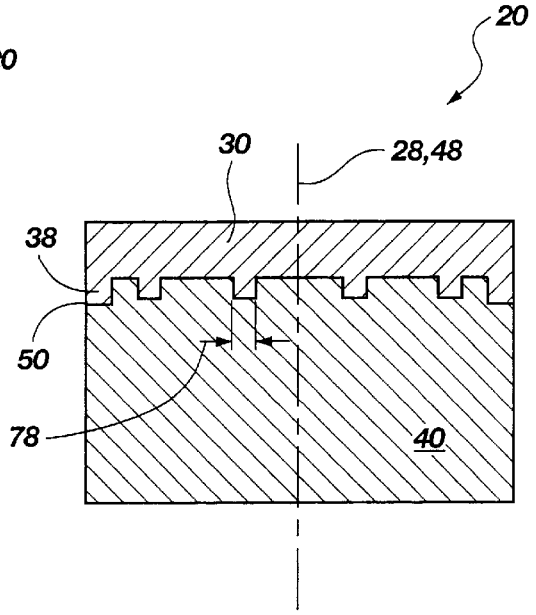
FIG. 4 is a cross-sectional side view of a drill bit cutter of the invention, as taken along line 4—4 of FIG. 2.

As depicted in FIGS. 2 through 4, a typical cutter 20 of the invention is cylindrical about longitudinal central axis 28 thereof Cutter 20 comprises a diamond table 30 with cutting face 34 and an interfacial surface 32 adjacent an interfacial surface 42 of substrate 40 that is able to withstand high applied drilling forces because of a high strength of mutual affixation between the diamond table 30 and substrate 40 provided by the present invention. The interfacial surfaces 32 and 42, when taken together, are considered to be the interface 50 between diamond table 30 and substrate 40. Interface 50 is generally non-planar, i.e., having three-dimensional characteristics, and includes portions of diamond table 30 which extend into and are accommodated by substrate 40, and vice versa. The table 30 may be formed of diamond, a diamond composite, or other superabrasive material. Substrate 40 is typically formed of a hard material such as a carbide, and preferably a tungsten carbide.

As shown in FIGS. 2–4, cutter 20 has a three-dimensional substrate surface pattern 46 which mates, or cojoins, with three-dimensional diamond table surface pattern 36.

In accordance with the invention, surface patterns 36, 46 comprise complementary raised, or protrusive, portions 52 and depressed, or receptive, portions 54 which include at least one annular member, such as complementary annular members 60A, 60B of which individual annular members can be circular, polygonal, or a combination of both and which are positioned about a pattern axis 48. Pattern axis 48 may coincide with cutter central axis 28. Each annular, circular, polygonal, or combination thereof, member 60 comprises a ring; i.e. it has a relatively thin radial width 78 preferably less than or approximately equal to the thickness of diamond table 30. A plurality of radial members 70 generally radiates outwardly from pattern axis 48, each radial member 70 intersecting the annular member, or members, 60. Furthermore, radial members 70 may either have a constant or changing width 82 with width 82 being about 0.04 to 0.4 times the cutter diameter 80. Stated differently, width 82 preferably does not exceed the approximate maximum thickness of diamond table 30. However, width 82 can exceed the preferred ranges if desired.

The number of radial members 70 may vary from about three to about twenty-five or more. Typically, the number of radial members 70 is about six to fifteen, depending upon suitability for the particular usage conditions.

As shown in the embodiment of FIGS. 2–4, two concentric polygonal annular members 60A, 60B are uniformly joined by radial members 70, wherein neither the circular, nor annularly shaped, members 60A, 60B, or radial members 70 extends outwardly to the periphery 56 of cutter 20. In these figures, polygonal annular members 60A, 60B and intersecting radial members 70 project from diamond table 30.

Also illustrated in FIGS. 2–4 is another feature, wherein diamond table 30 has a peripheral rim 38 which extends downwardly into substrate 40 to circumscribe it. This leaves a raised, or protrusive, portion 58 of substrate 40 which will ultimately prestress the polygonal surface pattern 36 of diamond table 30 in compression upon the solidification and subsequent cooling and depressurization of cutter 20 during the preferred post high-temperature, high-pressure manufacturing process thereof.

A preferred feature of the present invention is the exclusion of radial members 70 extending within the generally innermost portion of annular member 60A.

Surface patterns 36, 46 may have one or, alternatively, a plurality of concentric or non-concentric polygonal annular members 60A, 60B with at least four sides 66. Preferably, polygonal annular members 60 have at least six sides 66.

Radial members 70 and annular/circular/polygonal members 60A, 60B in general are preferably connected at junctions such that the diamond table 30 is in nearly uniform radial and circumferential compression so as to be compressively prestressed. Preferably, the inner portion of the diamond table 30 is placed in radial compression and the exterior of the diamond table 30 is placed in circumferential prestress so that the net result is that the disclosed cutter has a diamond table 30 which has a more favorable state of compression. Such prestressing occurs upon cooling cutter 20 from a high-temperature, high-pressure manufacturing process used in forming the superabrasive compact of the cutter onto the preformed carbide substrate.

Any irregularity, or three-dimensional configuration, at the interface may be looked upon as both a projection, or protrusion, of the substrate into the diamond table and the inverse, i.e., a projection, or protrusion, of the diamond table into the substrate. If one defines the interfacial space as that between the two planes defining the relative penetration of each member (table, substrate) into the other member, either the material volume of the diamond table or that of the substrate may predominate, or they may occupy substantially equal portions of the interfacial space.

Figure 5:
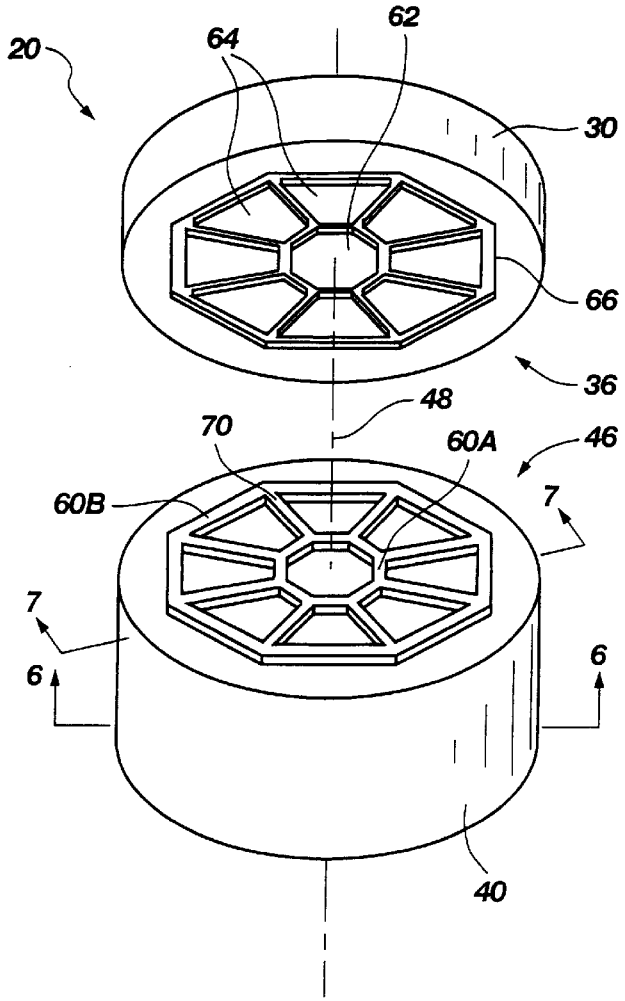
FIG. 5 is an isometric exploded view of another exemplary drill bit cutter of the invention.
Figure 6:
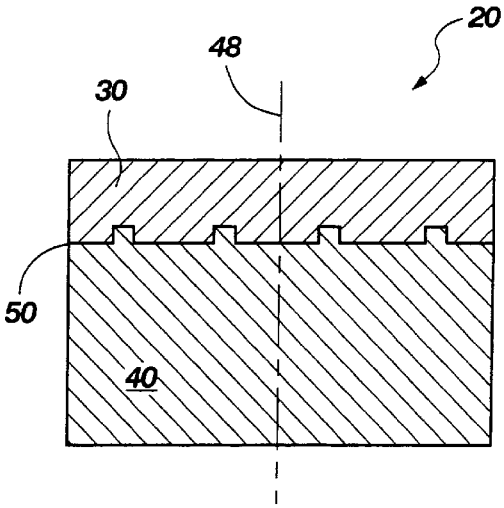
FIG. 6 is a cross-sectional side view of another exemplary drill bit cutter of the invention, as taken along line 6—6 of FIG. 5.
Figure 7:
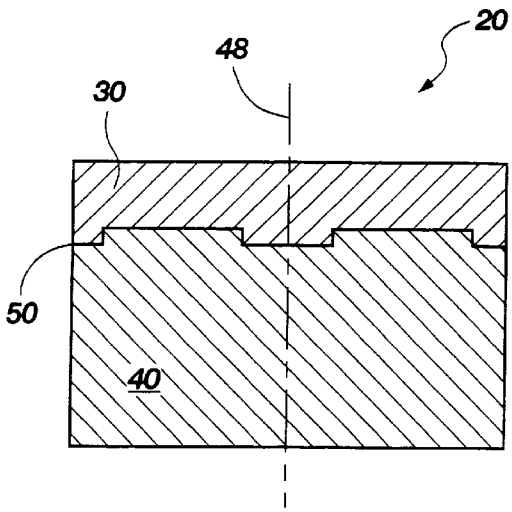
FIG. 7 is a cross-sectional side view of another exemplary drill bit cutter of the invention, as taken along line 7—7 of FIG. 5.

FIGS. 5–7 depict an embodiment in which polygonal annular members 60A, 60B and radial members 70 project from substrate 40, i.e., the inverse of FIGS. 2–4. Another feature shown in FIGS. 5–7 is an absence of peripheral rim 38. In this embodiment, a spider web-shaped raised, or protrusive surface, pattern 46 of substrate 40 places trapezoidal portions 64 of the diamond table 30 and a central portion 62 into a compressively prestressed condition.

Figure 8:
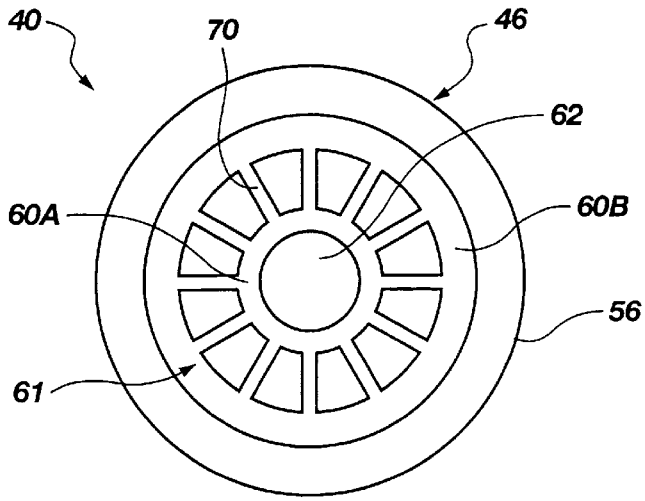
FIG. 8 is a plan view of an interface between a diamond table and a substrate of an additional exemplary drill bit cutter of the invention and FIG. 8A is a plan view of a variant of the interface of FIG. 8.
Figure 8A:
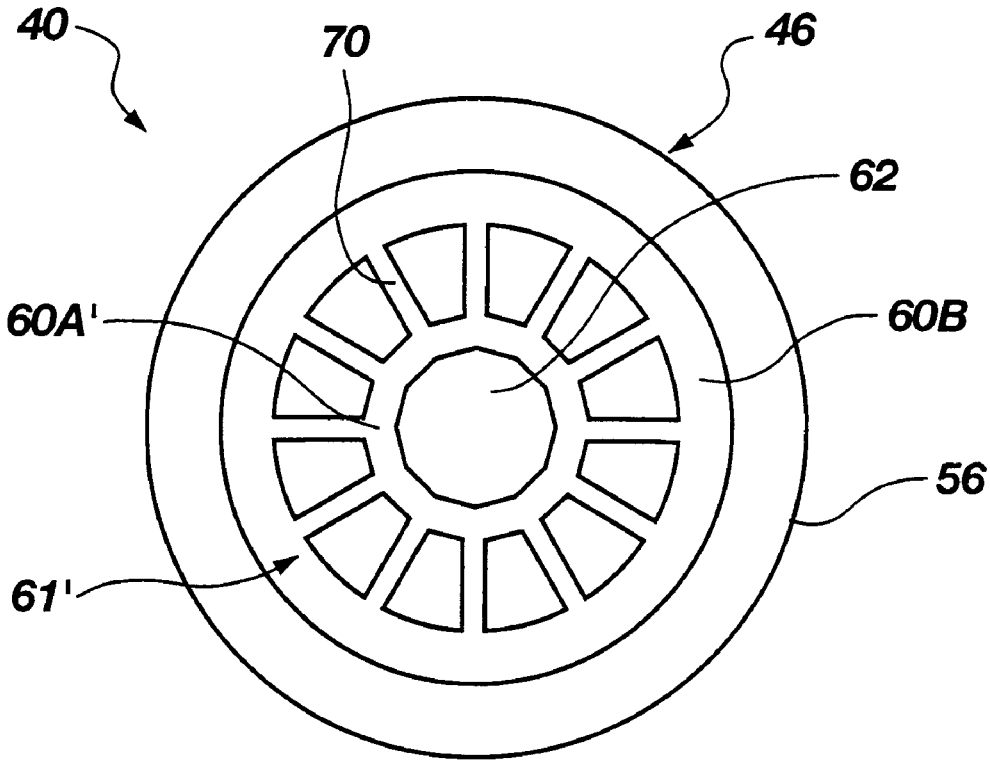
Figure 11:
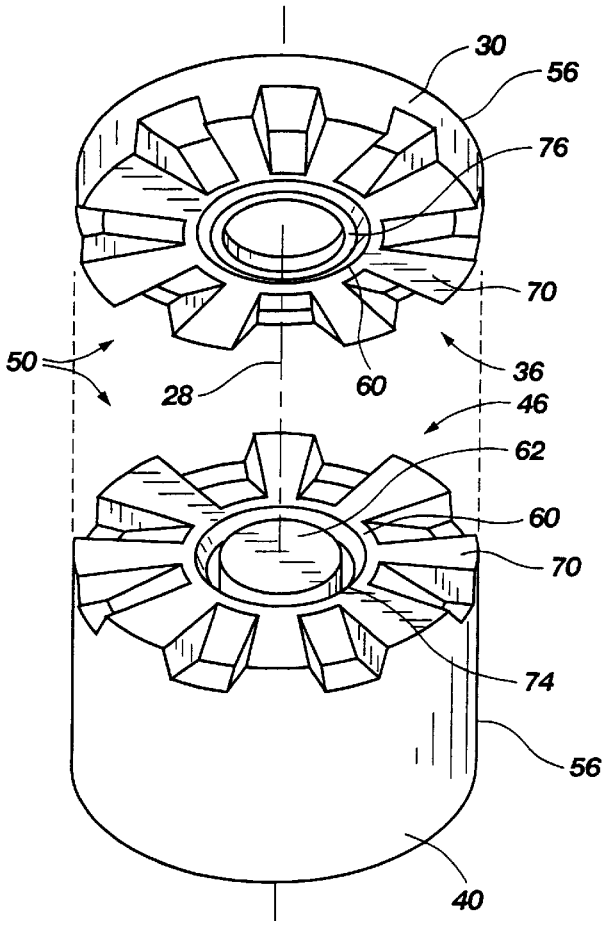
FIG. 11 is an isometric exploded view of another drill bit cutter of the invention.
Figure 13:
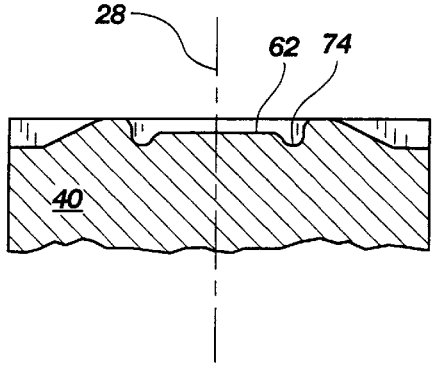
FIG. 13 is a cross-sectional side view of a substrate of another drill bit cutter of the invention, as taken along line 13—13 of FIG. 12.
Figure 14:
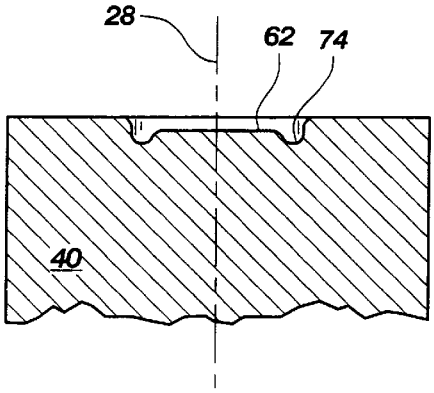
FIG. 14 is a cross-sectional side view of a substrate of another drill bit cutter of the invention, as taken along line 14—14 of FIG. 12.
Figure 12:
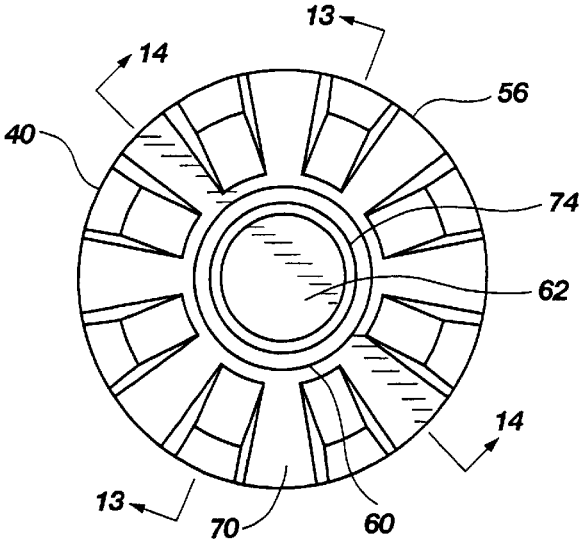
FIG. 12 is a plan view of an interfacial area on a substrate of another drill bit cutter of the invention.

FIG. 8 illustrates a "wheel" surface pattern 46 having radial members or spokes 70 connecting an inner annular circular member 60A and an outer annular circular member 60B. The entire pattern 61 is spaced from periphery 56 of substrate 40. FIG. 8A illustrates another "wheel" surface pattern 46 having radial members or spokes 70 connecting an inner annular polygonal member 60A and an outer annular circular member 60B. The entire pattern 61' is spaced from periphery 56 of substrate 40.

Figure 9:
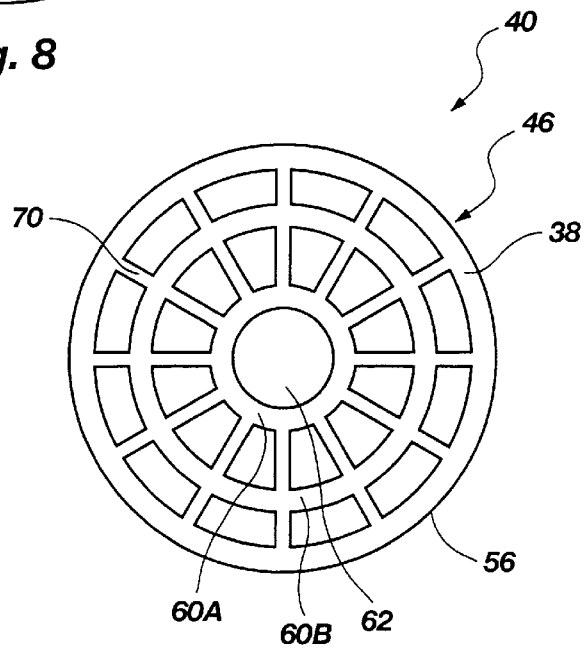
FIG. 9 is a plan view of an interface between a diamond table and a substrate of another exemplary drill bit cutter of the invention.

FIG. 9 depicts a surface pattern 46 having three concentric circular annular members 60A, 60B, and peripheral rim 38, with a plurality of radial members or spokes 70 intersecting and connected to each annular circular member 60A, 60B.

Figure 10:
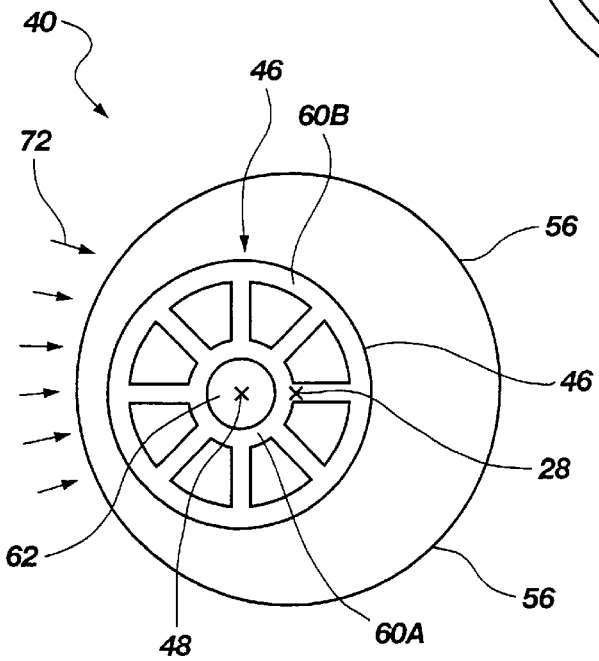
FIG. 10 is a plan view of an interface between a diamond table and a substrate of an additional exemplary drill bit cutter of the invention.

FIG. 10 shows another feature which may be used. In this embodiment, surface pattern 46 is placed off-center of cutter substrate 40. Thus, pattern axis 48 and central cutter axis 28 are displaced from each other. In practice, such may be used when the cutter is to be used where impinging forces 72 are applied over a relatively small area, and the pattern axis 48 is closer to the direction from which the forces impinge.

If desired, a surface pattern 36, 46 utilizing the combination of both a circular annular member 60A and a polygonal annular member 60B may be used, not only with respect to the embodiment shown in FIG. 10, or in the other figures but with all embodiments of the present invention. In FIGS. 11–14, another embodiment of the invention is shown with a gear-configured interface 50 of intermeshing diamond table surface pattern 36 and substrate surface pattern 46. Each of diamond table 30 and substrate 40 has a series of radially projecting members 70 which intersect the outer cutter periphery 56 and an inner circular annular member 60. The substrate 40 is shown with an annular depression 74 within the inner portion of circular annular member 60. Diamond table 30 has a complementary projecting member 76 which fits into and is received by annular depression 74. The particular pattern may be varied in many ways, provided a series of radial members 70 intersects with at least one circular or polygonal annular member 60. For example, projecting radial members 70 of substrate 40 may be of the same or differing shape, width, and depth as the projecting radial members 70 of the diamond table 30.

For ease of illustration, the drawings generally show the interfacial surfaces 32, 42 as having sharp corners. It is understood, however, that in practice, it is generally desirable to have rounded or bevelled corners at the intersections of planar surfaces, particularly in areas where cracking may propagate. Furthermore, the various circular and polygonal annular members 60 shown in the figures are illustrative, and annular members 60 may also have geometries incorporating arcuate, or curved, segments combined with straight segments in an alternating fashion, for example, to produce an irregularly shaped, generally annular member if desired.

The substrate 40 and/or diamond table 30 may be of any cross-sectional configuration, or shape, including circular, polygonal and irregular. In addition, the diamond table 30 may have a cutting face 34 which is flat, rounded, or of any other suitable configuration.

Figure 15A:
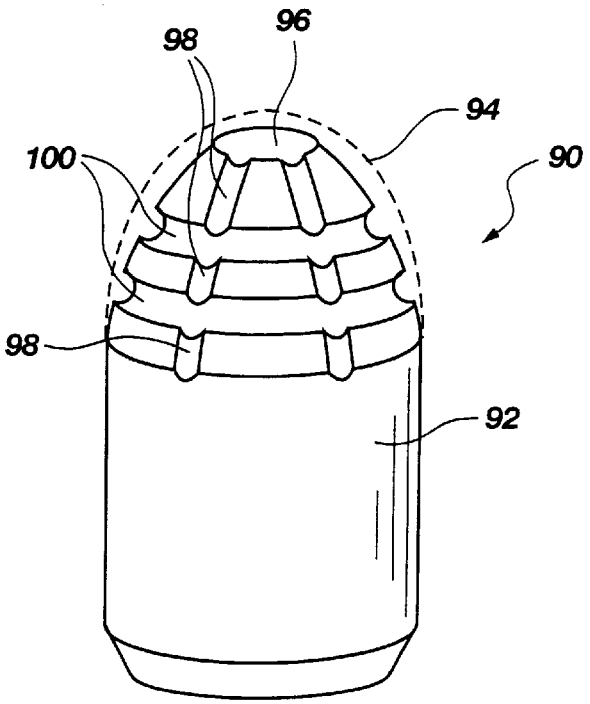
FIG. 15A is a front view of another drill bit cutter embodying the present invention.
Figure 15B:
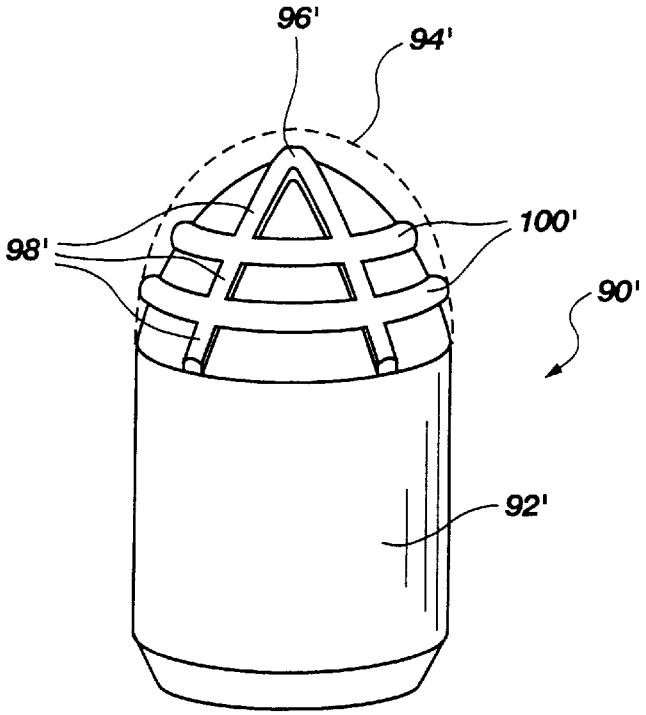
FIG. 15B is a front view of yet another drill bit cutter embodying the present invention.

FIG. 15A depicts another embodiment of the present invention wherein a cutter 90 is particularly suitable for, but not limited to, use as a rolling cone insert in a roller cone, or rock, drill bit. Cutter 90 has a carbide, preferably tungsten carbide, substrate 92 and has a superabrasive or diamond table, or compact, 94 shown in phantom placed upon substrate 92 in the manners known and discussed above. The contoured interface between diamond compact 94 and substrate 92 is provided with generally radially oriented grooves 98 preferably extending from preferably planar center 96 toward the outer circumference of cutter 90. Generally annular, or concentric, grooves 100 extending circumferentially preferably intersect and segment radial grooves 98 into a plurality of interrupted, generally radially oriented grooves to provide the desired compressive prestress within diamond compact 94 and in the vicinity of the interface. More particularly, the interior portion of diamond table, or compact, 94 is preferably placed in radial compression and the exterior portion of the diamond table, or compact, 94 is placed in circumferential compression with the net result of generally biaxial compressive prestresses being distributed throughout the diamond table, or compact, 94 and the interface between substrate 92 to better withstand the various types of primarily tensile forces acting on the cutter when placed in service. Furthermore, radially oriented grooves 98 and/or annular grooves 100 may alternatively be configured to be ribs protruding from substrate 92 and received within diamond compact 94 with such a configuration being shown in FIG. 15B. As shown in FIG. 15B, cutter 90' can be constructed with the same materials and processes as described with respect to cutter 90 but instead has a substrate 92' also having a diamond table, or compact, 94' shown in phantom placed upon substrate 92' as known in the art. However, the contoured interface between diamond compact 94' and substrate 92' is provided with generally radially oriented raised ribs, or ridges, 98' preferable extending from preferably raised center 96' toward the outer circumference of cutter 90'. Generally annular, or concentric, raised portions, referred to as ribs, or ridges, 100' extending circumferentially preferably intersect and join with radial ridges 98' to achieve the same results as described with respect to cutter 90 of FIG. 15A. In a like manner, diamond compact 94' would have an interface accommodating the raised ridges 98', 100' of substrate 92' but in a reverse pattern as described earlier. When constructing a cutter in accordance with alternative cutter 90', care must be exercised not to allow the ribs, or raised portions, to protrude too far into diamond compact 94' so as to provide a relatively thin, or reduced thickness, compact 94' where such raised portions are placed to make the superabrasive table, or compact, 94' vulnerable to localized chipping or breakage.

As can now be appreciated, a cutter interface embodying the present invention provides a cutter which has greater resistance to fracture, spalling, and delamination of the diamond table, or compact.

Figure 16:
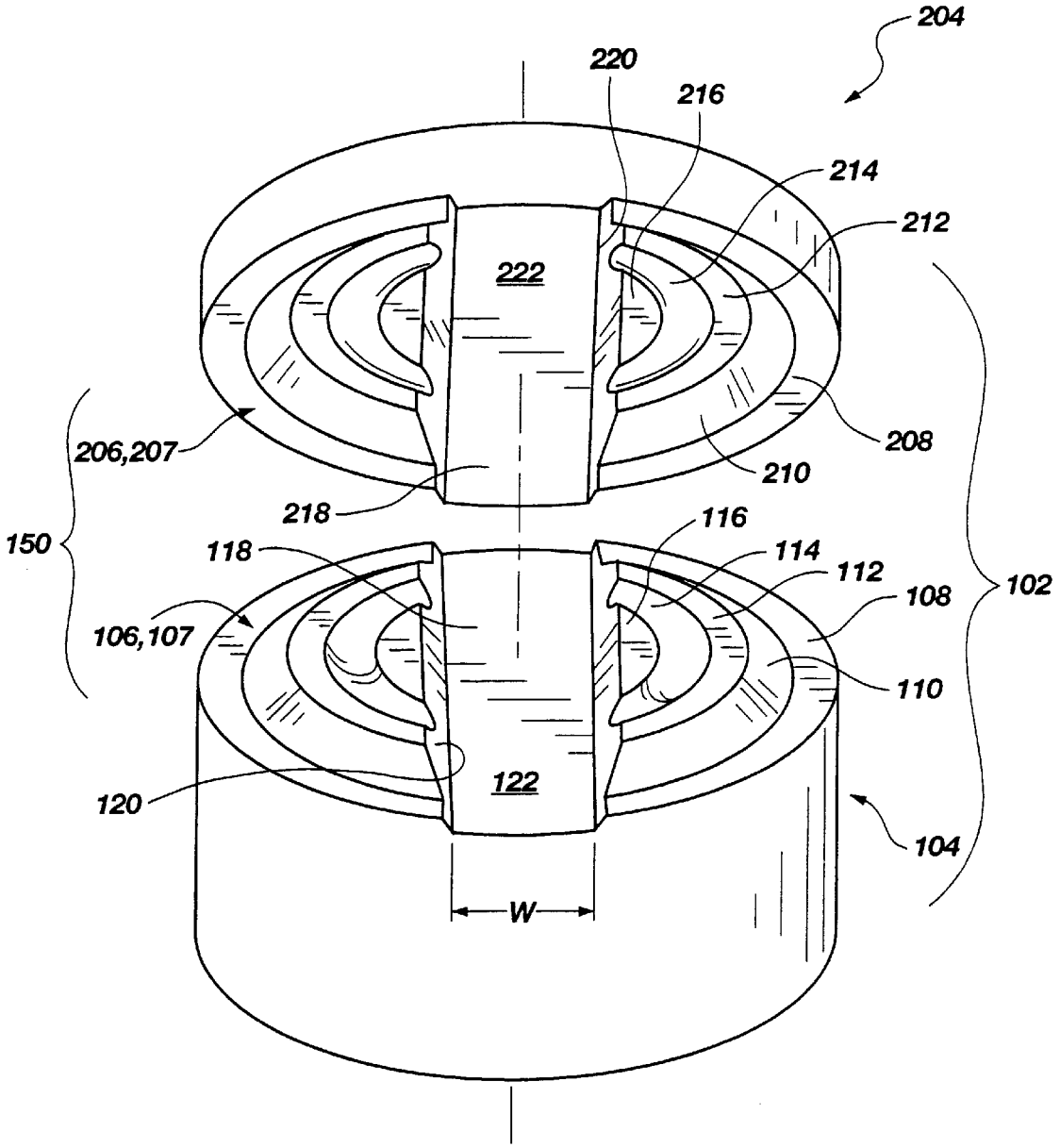
FIG. 16 is an isometric exploded view of yet another drill bit cutter embodying the present invention.

Referring now to FIG. 16, which provides an exploded illustration of yet another cutter embodying the present invention, cutter 102 includes a substrate 104 having a superabrasive compact, or diamond table, 204 removed from interface 150 which includes substrate interface surface 106 having a pattern 107 and diamond table interface surface 206 having a mutually complementary but reverse pattern 207. Substrate interface pattern 107 includes circumferential rim portion 108 and an inwardly sloping circumferential wall 110 leading to a first raised portion 112. First raised portion 112 preferably has a generally planar surface, but is not limited to such. Inward of first raised portion 112 is a concentric or annular groove 114 and inward of groove 114 is a second raised portion 116. As can be seen in FIG. 16, a full-diameter, generally rectangularly shaped slot 118 extending to a preselected depth divides interface pattern 107 into symmetrical halves with slot 118 having walls 120 set apart by a width W. Slot 118 is preferably provided with a generally planar bottom surface 122.

In a reverse fashion, the interfacial pattern 207 of interface surface 206 of diamond table 204 is provided with a peripheral rim 208 which cojoins with rim portion 108, and sloping wall 210 cojoins with sloping wall 110. First recessed portion 212 separated by protruding concentric ridge 214 and second recessed portion 216 respectively accommodate raised portions 112 and 116 and groove 114 of substrate 104. Also extending across the full diameter pattern 207 of interface surface 206 of diamond table 204 is a generally rectangular tang, or tab, 218 to correspond and fill rectangular slot 118. Tang walls 220 likewise cojoin with slot walls 120 and tang surface 222 cojoins with bottom surface 122 of slot 118. Tang 218, in combination with slot 118, in effect provides the previously described interfacial stress optimization benefits of the radially extending grooves and complementary raised portions of the cutters illustrated in the previous drawings.

Preferably, width W of slot 118/tang 218 ranges from approximately 0.04 to 0.4 times the diameter of cutter 102. However, width W of slot 118/tang 218 may be of any suitable dimension. Preferably, the depth of slot 118/tang 218 does not exceed the approximate thickness of superabrasive table 204 extending over substrate 104 in other regions than those directly above slot 118/tang 218. In other words, the approximate depth of slot 118/tang 218 preferably does not exceed the approximate minimum thickness of superabrasive table 204. However, slot 118/tang 218 can have any depth deemed suitable. Although slot 118 and tang 218 have been shown to have the preferred generally rectangular cross-sectional geometry including generally planar walls 120, 220 and surfaces 122, 222, slot 118/tang 218 can be provided with other cross-sectional geometry if desired. For example, walls 120 can be generally planar but be provided with radiused corners proximate bottom surface 122 to form a more rounded cross-section. Walls 120 and bottom surface 122 can further be provided with non-planar configurations if desired so as to be generally curved, or irregularly shaped.

Correspondingly, tang 218 can be provided with radiused edges where walls 220 intersect surface 222 to provide a tang of a generally more curved cross section than the preferred generally rectangular cross section as shown. Walls 220 and surface 222 can further be provided with non-planar configurations to correspond and complement non-planar configurations chosen for walls 120 and bottom surface 122 of slot 118.

Although cutter 102 is shown with the interfacial end of substrate 104 being generally planar, or flat, across raised portions 116, 112 and rim portion 108, the general overall configuration of substrate interface surface 106 can be dome, or hemispherically, shaped, such as the interfacial ends of substrates 92 and 92' of cutters 90 and 90' respectively illustrated in FIGS. 15A and 15B, yet maintain the preferred interfacial pattern shown in FIG. 16 or variations thereof Similarly, superabrasive table 204 would be reversely configured and shaped to form a generally dome-shaped table, such as tables 94 and 94', and would be disposed over and having a complementary diamond table interface surface 206 to accommodate such a modified substrate interface surface 106. A modified cutter having such a hemispherically shaped substrate and superabrasive table is particularly suitable for installation and use on roller cone style drill bits in which a plurality of cutters is installed on one or more roller cones so as to be moveable with respect to the drill bit while engaging the formation.

Thus, it can be appreciated that a single, large, radially or diametrically extending protrusion and a complementarily configured recessed portion can also be used to achieve the benefits of the present invention.

As with cutters 90 and 90', illustrated in FIGS. 15A and 15B respectively, cutter 102 can have patterns 107 and 207 reversed. That is, a tang protruding upwardly from substrate interface surface 106 is disposed into a receiving slot in diamond table interface surface 206. Similarly, raised portions 112 and 116 could be instead recessed portions to accommodate complementary raised portions extending from diamond table 204.

It will be apparent that the present invention may be embodied in various combinations of features, as the specific embodiments described herein are intended to be illustrative and not restrictive, and other embodiments of the invention may be devised which do not depart from the spirit and scope of the following claims and their legal equivalents.

What is claimed is:

1. A cutter for installation on tools used in forming bore holes in a subterranean formation, comprising:

a substrate;

a layer of superabrasive material having a cutting surface secured over an end of the substrate; and an interface between the substrate and the layer of superabrasive material, wherein the cutter has a first central axis generally perpendicular to the interface, the interface including a protrusive portion having a second central axis distal from the first central axis and comprising at least one protrusive, generally annular member and at least three protrusive, generally radially extending members intersecting the at least one protrusive, generally annular member.

2. The cutter of claim 1, wherein the protrusive portion comprises a web.

3. The cutter of claim 1, wherein a generally central region of the protrusive portion of the interface within the at least one protrusive, generally annular member is unintersected by the at least three protrusive, generally radially extending members.

4. The cutter of claim 1, wherein the substrate and the layer of superabrasive material have a conjoining periphery, and the protrusive portion is within the conjoining periphery and distal therefrom.

5. The cutter of claim 1, wherein the second central axis is distal from the first central axis in a radial direction toward major forces to be exerted on the cutter during drilling.

6. The cutter of claim 1, wherein the at least one protrusive, generally annular member is continuous and is of at least one of a circular geometry and a polygonal geometry.

7. The cutter of claim 1, wherein the at least one protrusive, generally annular member comprises at least two concentric circular members.

8. The cutter of claim 7, wherein one of the at least two concentric circular members encircles the interface at a lateral periphery thereof.

9. The cutter of claim 7, wherein the at least one protrusive generally annular member comprises two to six concentric circular members.

10. The cutter of claim 7, wherein the interface between the substrate and the layer of superabrasive material comprises a generally hemispherical configuration.

11. The cutter of claim 10, wherein the layer of superabrasive material comprises the protrusive portion.

12. A cutter for installation on tools used in forming bore holes in a subterranean formation, comprising:

a substrate;

a layer of superabrasive material having a cutting surface secured over an end of the substrate; and an interface between the substrate and the layer of superabrasive material, the interface including a protrusive portion comprising at least one protrusive, generally annular member including at least two concentric polygonal members and at least three protrusive, generally radially extending members intersecting the at least one protrusive, generally annular member.

13. The cutter of claim 12, wherein the at least two concentric polygonal members each have at least four sides.

14. The cutter of claim 12, wherein the at least two concentric polygonal members each have at least six sides.

15. A cutter for installation on tools used in forming bore holes in a subterranean formation, comprising:

a substrate;

a layer of superabrasive material having a cutting surface secured over an end of the substrate; and an interface between the substrate and the layer of superabrasive material, the interface including a protrusive portion comprising at least one protrusive, generally annular member including at least one circular member and at least one polygonal member and at least three protrusive, generally radially extending members intersecting the at least one protrusive, generally annular member.

16. The cutter of claim 1, wherein the protrusive portion of the interface includes a circular member projecting axially from the layer of superabrasive material at a periphery thereof to define an outer periphery boundary for the interface.

17. The cutter of claim 1, wherein the at least three protrusive, generally radially extending members comprise a quantity of from about 3 to about 25.

18. The cutter of claim 1, wherein the at least three protrusive generally radially extending members comprise a quantity of from about 6 to about 15.

19. The cutter of claim 1, wherein the at least one protrusive, generally annular member has a width not exceeding a maximum thickness of the layer of superabrasive material.

20. The cutter of claim 1, wherein at least one of the at least three protrusive, generally radially extending members has a width not exceeding a maximum thickness of the layer of superabrasive material.

21. The cutter of claim 1, wherein at least a portion of the layer of superabrasive material is compressively prestressed by the interface.

22. The cutter of claim 1, wherein the at least one protrusive, generally annular member and the at least three protrusive, generally radially extending members protrude from the substrate and are receptively accommodated by the layer of superabrasive material.

23. The cutter of claim 1, wherein the at least one protrusive, generally annular member and the at least three protrusive, generally radially extending members protrude from the layer of superabrasive material and are receptively accommodated by the substrate.

24. The cutter of claim 1, wherein the cutter is installable on a rotary cone drill bit tool.

25. The cutter of claim 24, wherein the cutter is installable on a rotary cone of the rotary cone drill bit tool.

26. The cutter of claim 1, wherein the cutter is installable on a drag bit tool.

27. A rotary drill bit for drilling a subterranean formation, comprising:

a bit body having a face;

at least one cutting element mounted on the face of the bit body, the at least one cutting element comprising a substrate supporting a table of superabrasive material at a three-dimensional interface therebetween, the at least one cutting element having a first central axis generally perpendicular to the interface, the interface including a protrusive portion having a second central axis distal from the first central axis and having a pattern including at least one protrusive, generally annular member and at least three protrusive, generally radial members intersecting the at least one protrusive, generally annular member.

28. The drill bit of claim 27, wherein the protrusive portion comprises a web.

29. The drill bit of claim 27, wherein a generally central region of the protrusive portion of the interface within the at least one protrusive, generally annular member is unintersected by the at least three protrusive, generally radial members.

30. The drill bit of claim 27, wherein the substrate and the table of superabrasive material have a conjoining periphery, and the protrusive portion is within the conjoining periphery and distal therefrom.

31. The drill bit of claim 27, wherein the second central axis is distal from the first central axis in a radial direction toward major forces to be exerted on the at least one cutting element during drilling.

32. The drill bit of claim 27, wherein the at least one protrusive, generally annular member is continuous and consists of at least one of a circular geometry and a polygonal geometry.

33. The drill bit of claim 27, wherein the at least one protrusive generally annular member comprises at least two concentric circular members.

34. The drill bit of claim 33, wherein one of the at least two concentric circular members encircles the interface at a lateral periphery thereof.

35. The drill bit of claim 33, wherein the at least one protrusive generally annular member comprises two to six concentric circular members.

36. The drill bit of claim 27, wherein the protrusive portion of the interface includes a circular member projecting axially from the table of superabrasive material at a periphery thereof to define an outer periphery boundary for the interface.

37. The drill bit of claim 27, wherein the at least three protrusive, generally radial members comprise a quantity of from about 3 to about 25.

38. The drill bit of claim 27, wherein the at least three protrusive generally radial members comprise a quantity of from about 6 to about 15.

39. The drill bit of claim 27, wherein the at least one protrusive, generally annular member has a width not exceeding a maximum thickness of the table of superabrasive material.

40. The drill bit of claim 27, wherein at least one of the generally radial members has a width not exceeding a maximum thickness of the table of superabrasive material.

41. The drill bit of claim 27, wherein at least a portion of the table of superabrasive material is compressively prestressed by the interface.

42. The drill bit of claim 27, wherein the at least one protrusive, generally annular member and the at least three protrusive, generally radial members protrude from the substrate and are respectively accommodated by the table of superabrasive material.

43. The drill bit of claim 27, wherein the at least one protrusive, generally annular member and the at least three protrusive, generally radial members protrude from the table of superabrasive material and are receptively accommodated by the substrate.

44. A rotary drill bit for drilling a subterranean formation, comprising:

a bit body having a face;

at least one cutting element mounted on the face of the bit body, the at least one cutting element comprising a substrate supporting a table of superabrasive material at a three-dimensional interface therebetween, the interface including a protrusive portion having a pattern including at least one protrusive, generally annular member including at least two concentric polygonal members and at least three protrusive, generally radial members intersecting the at least one protrusive, generally annular member.

45. The drill bit of claim 44, wherein the at least two concentric polygonal members each have at least four sides.

46. The drill bit of claim 44, wherein the at least two concentric polygonal members each have at least six sides.

47. A rotary drill bit for drilling a subterranean formation, comprising:

a bit body having a face;

at least one cutting element mounted on the face of the bit body, the at least one cutting element comprising a substrate supporting a table of superabrasive material at a three-dimensional interface therebetween, the interface including a protrusive portion having a pattern including at least one protrusive, generally annular member including at least one circular member and at least one polygonal member and at least three protrusive, generally radial members intersecting the at least one protrusive, generally annular member.

48. A cutter for installation on tools used in forming bore holes in a subterranean formation, comprising:

a substrate;

a table of superabrasive material having a cutting surface secured over an end of the substrate; and an interface between the end of the substrate and the table of superabrasive material, the interface comprising at least one generally annular raised portion and at least one generally radially extending recessed portion bisecting the at least one generally annular raised portion and extending to a depth greater than a height of the at least one generally annular raised portion.

49. The cutter of claim 48, wherein the cutter has a cutter diameter and the at least one generally radially extending recessed portion of the interface extends essentially entirely across the cutter diameter.

50. The cutter of claim 48, wherein the end of the substrate is generally planar.

51. The cutter of claim 48, wherein the end of the substrate is generally hemispherical.

52. The cutter of claim 48, wherein the at least one generally annular raised portion has a width not exceeding a maximum thickness of the table of superabrasive material.

53. The cutter of claim 48, wherein at least a portion of the table of superabrasive material is compressively pre-stressed by the interface.

54. The cutter of claim 48, wherein the cutter is installable on a rotary cone drill bit tool.

55. The cutter of claim 54, wherein the cutter is installable on a rotary cone of the rotary cone drill bit tool.

56. The cutter of claim 48, wherein the cutter is installable on a drag bit tool.

57. The cutter of claim 48, wherein the at least one generally annular raised portion and the at least one generally radially extending recessed portion bisecting the at least one generally annular raised portion of the interface are located on a substrate interface surface.

58. A cutter for installation on tools used in forming bore holes in a subterranean formation, comprising:

a substrate;

a table of superabrasive material having a cutting surface secured over an end of the substrate; and an interface between the end of the substrate and the table of superabrasive material, the interface comprising at least one generally annular raised portion and at least one generally radially extending recessed portion bisecting the at least one generally annular raised portion, wherein the at least one generally radially extending recessed portion of the interface comprises a slot having generally planar, inclined side walls and a planar bottom surface.

59. The cutter of claim 58, wherein the slot is recessed a depth not exceeding approximately a minimum thickness of the table of superabrasive material and comprises a width not exceeding approximately 0.4 times the cutter diameter.

60. A cutter for installation on tools used in forming bore holes in a subterranean formation, comprising:

a substrate;

a table of superabrasive material having a cutting surface secured over an end of the substrate; and an interface between the end of the substrate and the table of superabrasive material, the interface comprising at least one generally annular raised portion and at least one generally radially extending recessed portion bisecting the at least one generally annular raised portion, wherein the at least one generally annular raised portion of the interface comprises a generally downwardly and outwardly sloping wall terminating at a circumferential rim bisected by the at least one generally radially extending recessed portion.

61. The cutter of claim 60, wherein the interface comprises at least one second raised portion located radially inwardly from the at least one generally annular raised portion, the at least one second raised portion being bisected by the at least one generally radially extending recessed portion.

62. The cutter of claim 61, wherein the interface comprises at least one generally annular recessed portion positioned radially intermediately of the at least one generally annular raised portion and the at least one second raised portion, the at least one generally annular recessed portion being bisected by the at least one generally radially extending recessed portion.

63. The cutter of claim 62, wherein at least one of the at least one generally annular raised portion, the at least one second raised portion, and the circumferential rim comprises a generally planar surface.

64. A cutter for installation on tools used in forming bore holes in a subterranean formation, comprising:

a substrate;

a table of superabrasive material having a cutting surface secured over an end of the substrate; and an interface between the end of the substrate and the table of superabrasive material, the interface comprising at least one generally annular raised portion and at least one generally radially extending recessed portion bisecting the at least one generally annular raised portion, wherein the at least one generally annular raised portion and the at least one generally radially extending recessed portion bisecting the at least one generally annular raised portion of the interface are located on a superabrasive table interface surface.

65. A cutter for installation on tools used in forming bore holes in a subterranean formation, comprising:

a substrate;

a table of superabrasive material having a cutting surface secured over an end of the substrate; and an interface between the end of the substrate and the table of superabrasive material, the interface comprising at least one generally annular raised portion, at least one second raised portion located radially inwardly from the at least one generally annular raised portion, at least one generally annular recessed portion positioned radially intermediately therebetween and at least one generally radially extending recessed portion bisecting the at least one generally annular raised portion, the at least one second raised portion and the at least one generally annular recessed portion, the at least one generally radially extending recessed portion having a depth exceeding a depth of the at least one generally annular recessed portion.

* * * * *